US006610182B2

(12) United States Patent
Sakaki

(10) Patent No.: US 6,610,182 B2
(45) Date of Patent: Aug. 26, 2003

(54) CUP-TYPE PLATING APPARATUS AND METHOD FOR PLATING WAFERS

(75) Inventor: Yasuhiko Sakaki, Hiratsuka (JP)

(73) Assignee: Electroplating Engineers of Japan, Limited, Tokyo (JP)

( * ) Notice: Subject to any disclaimer, the term of this patent is extended or adjusted under 35 U.S.C. 154(b) by 86 days.

(21) Appl. No.: 09/883,574

(22) Filed: Jun. 18, 2001

(65) Prior Publication Data

US 2002/0066665 A1 Jun. 6, 2002

(30) Foreign Application Priority Data

Dec. 5, 2000 (JP) ..... 2000-370466

(51) Int. Cl.[7] ..... C25D 17/06; C25D 7/12

(52) U.S. Cl. ..... 204/275.1; 204/297.01; 204/297.08; 205/80; 205/157

(58) Field of Search ..... 204/275.1, 280, 204/297.01, 297.08; 205/80, 94, 157

(56) References Cited

U.S. PATENT DOCUMENTS 5,980,706 A * 11/1999 Bleck et al. ..... 204/297.14
6,024,856 A * 2/2000 Haydu et al. ..... 205/84
6,136,163 A * 10/2000 Sheung et al. ..... 204/198
6,231,743 B1 * 5/2001 Etherington ..... 205/83
2002/0020622 A1 * 2/2002 Hanson et al. ..... 204/222
2002/0108850 A1 * 8/2002 Sakaki ..... 204/232

FOREIGN PATENT DOCUMENTS

JP 05243236 A * 9/1993

* cited by examiner

*Primary Examiner*—Nam Nguyen
*Assistant Examiner*—Brian L. Mutschler
(74) *Attorney, Agent, or Firm*—Roberts & Mercanti, LLP

(57) ABSTRACT

The present cup-type plating apparatus improves a conventional cup-type plating apparatus and prevents the surface of a wafer due to a mist of the plating solutions from being contaminated. A plating solution is supplied to a wafer which is placed on a wafer support provided along an opening at the top of a plating tank from a solution-supply port provided at the bottom of the plating tank by an upward-moving stream; the plating solution is made to flow out of a solution-outlet port provided for the plating tank; and plating is performed while the plating solution is brought into contact with a surface of the placed wafer, which is to be plated, wherein the solution-outlet port has a solution-outlet path in which the discharged plating solution is isolated from the outer space.

15 Claims, 2 Drawing Sheets

CUP-TYPE PLATING APPARATUS AND METHOD FOR PLATING WAFERS

BACKGROUND OF THE INVENTION

1. Field of the Invention

The present invention relates to an apparatus for plating wafers for semiconductors, more particularly to a cup-type plating apparatus in which the wafer is placed on an opening of a plating tank and is subjected to plating.

2. Description of the Related Art

Recently, various kinds of plating, for example, formation of a bump, are performed in the manufacturing process of wafers for semiconductors. A cup-type plating apparatus is known as one of the apparatuses for plating the wafer.

In this cup-type plating apparatus, a plating solution is supplied to a wafer, which is placed on a wafer support provided along an opening at the top of a plating tank, via a solution-supply port provided at the bottom of the plating tank by an upward-moving stream, and flows out of a solution-outlet port provided for the plating tank; thus, plating is performed while bringing the plating solution into contact with a surface of the placed wafer to be plated.

In the cup-type plating apparatus, the plating solution supplied toward the surface of the wafer to be plated, by the upward-moving stream makes the plating solution into contact with the surface to be plated in a flowing state in which the solution spreads out from the center toward the periphery of the surface; thus, uniform plating can be performed on the entire surface to be plated. Since plating can be performed in such a manner that the wafer to be placed on the wafer support of the plating tank is successively replaced, the apparatus is widely used as a suitable apparatus for small-lot production or automatization of plating process.

In the conventional cup-type plating apparatus, the plating solution supplied from the solution-supply port by the upward-moving stream is flowed out from the solution-outlet port provided over the plating tank in a state in which the plating solution is directly exposed. Therefore, in this cup-type plating apparatus, a mist of the plating solutions may be generated due to the plating solution which flowed out of the plating tank, and may adhere to the surface (the rear of the surface to be plated) of the wafer placed on the wafer support. Conventionally, since the contaminant on the surface of the wafer due to the mist of the plating solutions is removed in a later cleaning process, it has not been perceived to pose a particular problem.

The development of plating process in which more wafers can be speedily processed is in progress as a demand for the wafers rapidly increases. As an example, the supply of the plating solution or the current density for plating is increased for realizing high-speed plating. When the supply of the plating solution is increased, the mist of the plating solutions is also increased, and the contaminant on the surface of the wafer resulting from the mist is more prominent than it was; thus, the necessity for afterward careful cleaning arises.

Since a large number of wafers are plated at the same time, a plating unit having a plurality of cup-type plating apparatuses may be manufactured, thereby realizing an efficient plating process. In this case, a large amount of the mist of the plating solutions is likely to be generated at a time due to the plating solution flowing out of a plurality of the plating tanks, and consequently, the contaminant on the surface of the wafer is likely to be increased.

Furthermore, the recent wafer manufacturing process is almost automated; wherein the wafers are successively moved in the processes, and in many cases, after completion of plating, the cleaned and dried wafers are moved to a clean room, and a downstream process is then performed. Therefore, when no measures against the mist of the plating solutions is taken, for instance, when a large amount of mist of the plating solutions exists in the plating process, it may leak into the clean room to generate contamination in the clean room; and, accordingly, it is not preferable for manufacturing wafers.

SUMMARY OF THE INVENTION

In the recent wafer-manufacturing process, because of the foregoing reasons, a cup-type plating apparatus in which the contamination on the surface of a wafer due to a mist of plating solutions can be prevented as much as possible is strongly required. Accordingly, it is an object of the present invention to provide a technique in which the conventional cup-type plating apparatus is improved, and the contamination on the surface of the wafer due to the mist of the plating solutions can be prevented.

In order to achieve the above object of the present invention, a plating solution is supplied to a wafer which is placed on a wafer support provided along an opening at the top of a plating tank from a solution-supply port provided at the bottom of the plating tank by an upward-moving stream; the plating solution is made to flow out of a solution-outlet port provided for the plating tank; and plating is performed while the plating solution is brought into contact with a surface of the placed wafer, which is to be plated; wherein the solution-outlet port has a solution-outlet path in which the discharged plating solution is isolated from the outer space.

In the cup-type plating apparatus according to the present invention, since the plating solution flowing out of the plating tank is in a state isolated from the outer space, that is, a state separated from the space in which the surface (the rear of the surface to be plated) of the wafer placed on the wafer support is exposed, the contamination on the surface of the wafer due to the mist of the plating solutions can be prevented.

The structure of the solution-outlet path according to the cup-type plating apparatus in the present invention is not particularly limited as long as the it is a structure in which the plating solution flowing out of the solution-outlet port which is provided for the plating tank is isolated from the outer space, that is, it does not directly come into contact with the outer space. For example, an outlet pipe may be provided as the solution-outlet path in such a manner that it is connected to the solution-outlet port provided for the plating tank; alternatively, a solution-outlet path may be provided in which a cover case capable of covering the outer periphery of the plating tank, so that the plating solution flowing out of the solution-outlet port can be isolated from the outer space.

In the cup-type plating apparatus according to the present invention, preferably, the solution-outlet path passes through the interior of the wall of the tank from the solution-outlet port provided on the side of the inner periphery of the wall of the tank, which constructs the plating tank. Thus, the solution-outlet path in which the plating solution can pass through is provided in the interior of the wall of the tank, which constructs the plating tank, so that the plating solution flowing out of the solution-outlet port provided on the inner periphery of the wall of the tank is isolated from the outer space. Accordingly, a space for providing the solution-outlet path on the outside of the plating tank is not required, and the cup-type plating apparatus itself can be made compact. It is particularly effective when constructing a plating unit having a plurality of the cup-type plating apparatuses.

In order to reliably prevent the contamination on the surface of the wafer due to the mist of the plating solutions, preferably, a shutting means capable of closing the opening of the plating tank is provided. In the cup-type plating apparatus, while plating is performed in such a manner that the wafer which is placed on the wafer support provided along the opening of the plating tank is successively replaced, the opening of the plating tank is in an opened state during replacement. At this time, the mist of the plating solutions leaks a little from the opening into the outer space. When replacing of the wafer is completed in a relatively short time, that is, the time of opening the opening is short, it has little effect on the contamination on the surface of the wafer; however, when replacing of the wafer requires a long time, that is, when the opening is opened for a long time, the amount of mist of the plating solutions which leaks out is increased, and accordingly, there is a fear that it exerts an influence on the contamination on the surface of the wafer. Therefore, when the opening of the plating tank is closed when necessary by the shutting means capable of closing the opening of the plating tank, the contamination on the surface of the wafer due to the mist of the plating solutions can be further reliably prevented.

PREFERRED EMBODIMENT OF THE INVENTION

A preferred embodiment of a cup-type plating apparatus according the present invention is described hereinbelow.

Figure 1:
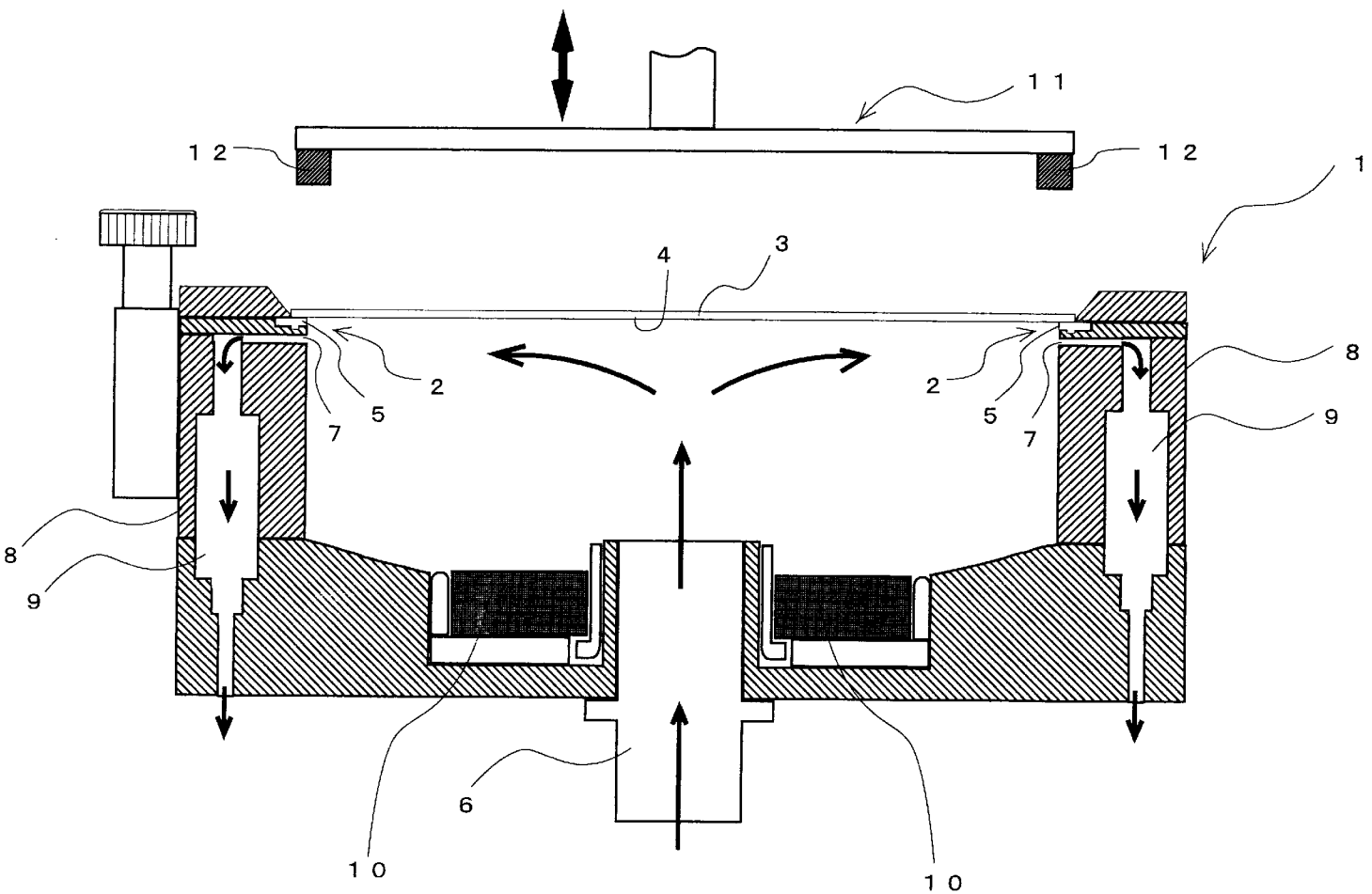
FIG. 1 is a cross sectional view of a cup-type plating apparatus according to the embodiment.

FIG. 1 shows a schematic sectional view of a cup-type plating apparatus in the embodiment. As shown in FIG. 1, the cup-type plating apparatus in the embodiment includes a wafer support 2 along an opening at the top of a plating tank 1, wherein a wafer 3 is placed on the wafer support 2, and plating is performed to a surface 4 of the wafer 3, which is to be plated. The wafer support 2 has a seal packing 5 being brought into contact with the periphery of the placed wafer 3 and having a ring cathode disposed thereon. In addition, a drawing of the ring cathode is omitted.

The plating tank 1 has a solution supply pipe 6 provided at the center of the bottom thereof. A solution-outlet port 7 is provided at a position below the wafer support 2 so that a plating solution supplied via the solution supply pipe 6 by an upward-moving stream reaches the vicinity of the center of the surface 4 to be plated, and forms a stream (as shown with bold arrows shown in FIG. 1) which spreads out toward the outer periphery of the wafer 2. In a wall 8 constructing the plating tank 1, there is provided a solution-outlet port 9 for feeding the plating solution flowing out of the solution-outlet port 7 to a plating-solution-storage tank (a drawing thereof is omitted). Also, an anode 10 is disposed around the solution supply pipe 6 in such a manner as to face the surface 4 of the wafer 3, which is to be plated.

In addition, the wafer 3 is fixed to the wafer support 2 with a vertically moveable pressing means 11. The pressing means 11 is moved downward to allow the entire periphery of the upper surface of the wafer 3 to be pressed by a circular pressing means 12 provided for the pressing means 11, and the wafer 3 is fixed to the wafer support 2. Thus, the ring cathode, which is not shown, provided for the seal packing 5 and the periphery of the wafer 3 are brought into contact with each other.

Figure 2:
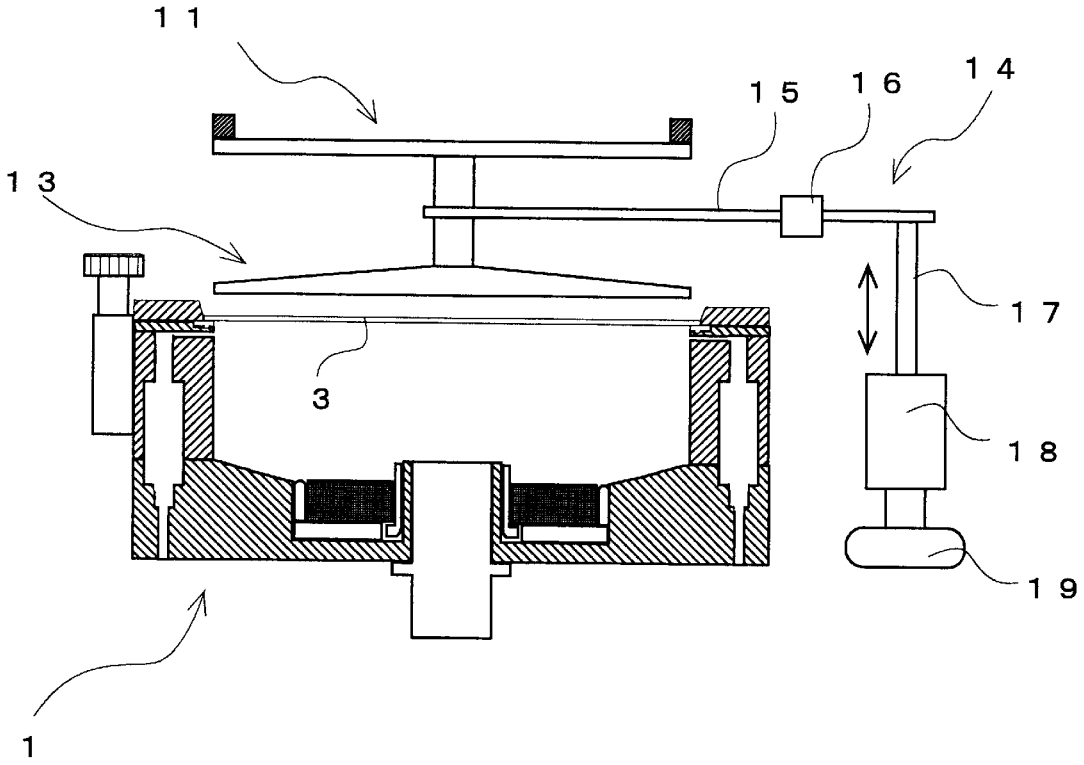
FIG. 2 is a schematic cross sectional view showing the cup-type plating apparatus and a shutter mechanism in the embodiment.

FIG. 2 shows a schematic sectional view in which a rotary switching unit 14 having the pressing means 11 and a shutting means 13 capable of closing the opening of the plating tank 1 is disposed in the vicinity of the plating tank 1. The pressing means 11 and the shutting means 13 are provided at one end of a supporting arm 15 in a vertically symmetric manner. The supporting arm 15 includes a rotary motor 16 for vertically switching the position of the pressing means 11 and the shutting means 13 by rotating them on a horizontal axis in a vertical direction. Another end of the supporting arm 15 is connected to a column 17. The column 17 can be vertically extended by an air cylinder 18 and is connected to a rotary actuator 19 to allow the supporting arm 15 to be rotated in the horizontal direction. In addition, the shutting means 13 is formed in a cover-shape corresponding to the opening of the plating tank 1.

In the cup-type plating apparatus, when plating of one wafer 3 is completed, the processed wafer 3 is removed, a new wafer 3 is placed, and plating is then started again. When replacing the wafer 3, after completion of plating, the pressing means 11 is moved upward away from the wafer 3 by the air cylinder 18, and is moved away from above the opening of the plating tank 1 by driving the rotary actuator 19. Subsequently, the plated wafer 3 is removed from the wafer support 2 by wafer-replacing means, which is not shown. In the cup-type plating apparatus according to this embodiment, the opening of the plating tank 1 is controlled to be closed by the shutting means 13 after the plated wafer 3 has been removed from the plating tank 1 until the new wafer 3 is prepared. After completion of plating, while the pressing means 11 moved away from above the opening of the plating tank 1 is located at a lower position, positional relationship between the pressing means 11 located at the lower position and the shutting means 13 located at the upper position is reversed by the rotary motor 16, and thereby the shutting means 13 is disposed at the lower position. In this state, the rotary actuator 19 is driven to move the shutting means 13 to above the opening of the plating tank 1, and to move the shutting means 13 downward by the air cylinder 18; thus, the opening of the plating tank 1 is closed.

When the new wafer 3 is prepared by the wafer-replacing means, which is not shown, the shutting means 13 is moved by a motion opposite to that when closing the opening of the plating tank 1, and the space above the opening of the plating tank 1 is opened. After the new wafer 3 is placed, the wafer 3 is fixed by the pressing means 11 and plating is started again.

Subsequently, a result of a contamination study on the surface of the wafer when plating was performed by the cup-type plating apparatus according to this embodiment in comparison with the conventional cup-type plating apparatus is described. The wafer used in plating has a diameter of 200 mm, and is a wafer with a seed metal in which seed metal of Cu is applied to a surface to be plated. In addition, a copper sulfate solution was used as the plating solution and a plating current was supplied to control a solution temperature to 20° C., a circulation amount of the solution is 15 l/min, and a theoretical current density on the surface to be plated is 1 A/dm$^2$, and plating in thickness of 1.0 $\mu$m (the plating-current supply time is 270 sec) was performed. The cup-type plating apparatus is in such a state in which the entire apparatus is enclosed in a case having a depth of 800 mm, a width of 1500 mm, and a height of 2100 mm and in which there is a closed space of 0.84 m$^3$ in capacity above the plating tank. The closed space in this case means a space formed by being separated by the case so that, when a mist of the plating solutions is generated from the cup-type plating apparatus, the mist of the plating solutions would not spread into the air on the outside of the case. Accordingly, in the cup-type plating apparatus according to this embodiment, the closed space does not come into contact with the plating solution flowing out of the plating tank; while, in the conventional cup-type plating apparatus, the plating solution flowing out of the plating tank comes into contact with the closed space.

The contamination study on the surface of the wafer is performed in such a way that the cup-type plating apparatus according to the embodiment and the conventional cup-type plating apparatus are independently prepared, wherein ten wafers are successively replaced and subjected to plating, and the surface (the rear of the surface to be plated) of the plated wafer are each inspected.

The state of contamination on the surface of the plated wafers is measured by a foreign-matter detector (the unit name: Surf Scan, manufactured by KLT Tencall Co.), so-called Surf Scan. Consequently, the state of contamination on the surface of the ten wafers in which plating was performed by the cup-type plating apparatus according to the embodiment was found to be on the order of $10^{10}$ atm/cm$^3$. On the other hand, it was confirmed that in the conventional cup-type plating apparatus, all of the ten wafers are in a state of contamination on the order of $10^{12}$ atm/cm$^3$. As a result, it was found that, in the cup-type plating apparatus in the embodiment, the value indicating the state of contamination by the foreign-matter detector was better than that of the conventional type by the order of 2 digits. Thus, it was determined that the surface evidently became clean.

According to the cup-type plating apparatus of the present invention, plating of the wafer can be performed in a state in which the contamination on the surface of the wafer due to the mist of the plating solutions can be prevented, and the contamination of a clean space such as a clean room is also decreased.

What is claimed is:

1. A cup-shaped plating apparatus in which:

a plating solution is supplied to a wafer which is placed on a wafer support provided along an opening at a top of a plating tank from a solution-supply port provided at a bottom of the plating tank by an upward-moving stream;

the plating solution is made to flow out of a solution-outlet port provided for the plating tank; and plating is preformed while die plating solution is brought in contact with a surface of the placed wafer, which is to be plated, wherein the solution-outlet port is provided with a solution-outlet path for isolating discharged plating solution from an outer space; and wherein the cup-shaped plating apparatus comprises means for pressing a wafer against the wafer support, which means for pressing is attached via an intermediate shaft to a shutting means, which shutting means is formed in a cover shape corresponding to the open top of the plating tank and which is capable of closing the open top of the plating tank;

a supporting arm having an end thereof attached to the shaft, which supporting arm comprises a rotary motor for switching the position of the means for pressing and the shutting means by rotating them along a horizontal axis.

2. The cup-shaped plating apparatus according to claim 1, wherein the solution-outlet path passes through an interior of a tank wall from the solution-outlet port provided on a side of an inner periphery of the plating tank, said tank wall constituting the plating tank.

3. The cup-shaped plating apparatus of claim 1 further comprising an extendible column attached to another end of die supporting arm.

4. The cup-shaped plating apparatus of claim 3 wherein the column is capable of being extended by an air cylinder intermediate to the column.

5. The cup-shaped plating apparatus of claim 4 wherein the column is connected to a rotary actuator which is capable of rotating the column, the supporting arm, the shaft, the means for pressing, and the shutting means in a horizontal direction.

6. A cup-shaped plating apparatus for wafers which comprises a plating tank having side walls, a bottom and an open top defining a central space;

a wafer support at the open lop capable of holding a wafer spanning across the open top;

a plating solution supply port at the bottom of the central space of the plating tank which is capable of flowing an upwardly moving stream of a plating solution into the central space toward the open top such that a plating solution is brought into contact with a surface of a wafer which is to be plated when the wafer is placed on the wafer support; and a plating solution outlet port in the central space adjacent to and below the open top on an inner periphery of a side wall of the plating tank; and wherein said cup-shaped plating apparatus further comprises means for pressing a wafer against the wafer support, which means for pressing is attached via an intermediate shaft to a shutting means, which shutting means is formed in a cover shape corresponding to the open top of the plating tank and which is capable of closing die open top of the plating tank;

a supporting arm having an end thereof attached to the shaft, which supporting arm comprises a rotary motor for switching the position of the means for pressing and the shutting means by rotating them along a horizontal axis.

7. The cup-shaped plating apparatus of claim 6 further comprising an anode at a bottom of the central space.

8. The cup-shaped plating apparatus of claim 6 further comprising an anode at a bottom of the central space and surrounding the plating solution supply port.

9. The cup-shaped plating apparatus of claim 6 wherein the plating solution outlet port extends through at least one side wall of the tank to a plating solution storage tank.

10. A method for plating wafers which comprises:

(a) providing a cup-shaped plating apparatus for wafers which comprises a plating tank having side walls, a bottom and an open top defining a central space;

a wafer support at the open top capable of holding a wafer spanning across the open top;

a plating solution supply port at the bottom of the central space of the plating tank which is capable of flowing an upwardly moving stream of a plating solution into the central space toward the open top such that a plating solution is brought into contact with a surface of a wafer which is to be plated when the wafer is placed on the wafer support; and a plating solution outlet port in the central space adjacent to and below the top opening on an inner periphery of a side wall of the plating tank; and wherein said cup-shaped plating apparatus further comprises means for pressing a wafer against the wafer support, which means for pressing is attached via an intermediate shaft to a shutting means, which shutting means is formed in a cover shape corresponding to the open top of the plating tank and which is capable of closing the open top of the plating tank;

a supporting arm having an end thereof attached to the shaft, which supporting arm comprises a rotary motor for switching the position of the means for pressing and the shutting means by rotating them along a horizontal axis;

(b) positioning a wafer on the wafer support;

(c) flowing a plating solution through the supply port through the central space, across a surface of the wafer facing the central space and then out the solution outlet port.

11. The method of claim 10 further comprising supplying a plating current to the wafer.

12. The method of claim 10 further comprising supplying a plating current to the wafer via an anode which is positioned at a bottom of the central space and surrounding the plating solution supply port.

13. The method of claim 10 further comprising pressing the wafer against the wafer support via means for pressing the wafer against the wafer support.

14. The method of claim 10 further comprising pressing the wafer against the wafer support via means for pressing the wafer against the wafer support after step (b), then removing the wafer from the wafer support after step (c).

15. The method of claim 10 subsequently comprising removing the wafer from the wafer support and covering the open top with shutting means formed in a cover shape corresponding to the open top of the plating tank.

* * * * *